US008240322B2

(12) United States Patent
Chang et al.

(10) Patent No.: US 8,240,322 B2
(45) Date of Patent: Aug. 14, 2012

(54) SPLASH-PROOF UMBRELLA STRUCTURE

(76) Inventors: Tzu-cheng Chang, Hualien County (TW); Chin-Sen Hsieh, Hualien County (TW); Chih-Chi Chou, Hualien County (TW)

( * ) Notice: Subject to any disclaimer, the term of this patent is extended or adjusted under 35 U.S.C. 154(b) by 107 days.

(21) Appl. No.: 12/830,669

(22) Filed: Jul. 6, 2010

(65) Prior Publication Data

US 2012/0006367 A1 Jan. 12, 2012

(51) Int. Cl.
*A45B 25/28* (2006.01)
*A45B 25/02* (2006.01)

(52) U.S. Cl. ..... 135/48; 135/27

(58) Field of Classification Search ..... 135/15.1, 135/27, 28, 33.2, 40, 48, 31
See application file for complete search history.

(56) References Cited

U.S. PATENT DOCUMENTS 5,111,835 A * 5/1992 Lin ..... 135/34.2
5,909,746 A * 6/1999 Doster et al. ..... 135/25.1
6,234,186 B1 * 5/2001 Tsai ..... 135/25.33
2004/0211451 A1 * 10/2004 Goh ..... 135/31
2007/0169801 A1 * 7/2007 Brader ..... 135/31
2008/0006313 A1 * 1/2008 Wang ..... 135/31
2009/0151760 A1 * 6/2009 Brader ..... 135/31

* cited by examiner

*Primary Examiner* — David Dunn
*Assistant Examiner* — Danielle Jackson

(57) ABSTRACT

A splash-proof umbrella structure comprises a rod passing through a slide sleeve sliding up and down along the rod. The slide sleeve is coupled to support sticks. A piece of umbrella cloth is arranged on the support sticks. The upper side of the rod has a first rod sleeve and a second rod sleeve. The first rod sleeve has first link rods coupled to the support sticks. The second rod sleeve has second link rods coupled to the first link rods. The bottom of the rod has a handle. When getting off a vehicle in rain, the user can open the umbrella in a confined space to prevent from being wetted by rainwater via sliding the slide sleeve upward to stretch the umbrella cloth bottom-up. When not in use, the umbrella cloth can be collapsed via sliding the slide sleeve toward the handle. Further, the handle can collect rainwater.

2 Claims, 5 Drawing Sheets

SPLASH-PROOF UMBRELLA STRUCTURE

BACKGROUND OF THE INVENTION

1. Field of the Invention

The present invention relates to a splash-proof umbrella structure, particularly to a splash-proof umbrella structure, which the user can open in a confined space to prevent from being wetted by rainwater when he gets off a vehicle in rain.

2. Description of the Related Art

After parking in rain, the driver or passenger usually opens the vehicle door, reaches out an umbrella and then opens the umbrella. When the conventional umbrella is being opened, the umbrella cloth is greatly expanded bottom-up. Thus, the user has to open the vehicle door more widely to facilitate opening the umbrella. However, such a doing should make rainwater splash the user and the equipment inside the vehicle. Based on many years' experience in the related field and via persistent research and experiment, the Inventor thus proposes a splash-proof umbrella structure, which the user can open in a confined space to prevent from being wetted by rainwater.

SUMMARY OF THE INVENTION

The primary objective of the present invention is to provide a splash-proof umbrella structure, which the user can open in a confined space to prevent from being wetted by rainwater when he gets off a vehicle in rain.

To achieve the abovementioned objective, the present invention proposes a splash-proof umbrella structure, which comprises a rod passing through a slide sleeve able to slide up and down along the rod. The slide sleeve is coupled to a plurality of support sticks. A piece of umbrella cloth is arranged on the support sticks. The upper side of the rod has a first rod sleeve and a second rod sleeve. The first rod sleeve has first link rods coupled to the support sticks. The second rod sleeve has second link rods coupled to the first link rods. The bottom of the rod has a handle able to collect rainwater. Thus is formed the plash-proof umbrella structure of the present invention. When getting off a vehicle in rain, the user can open the umbrella in a confined space to prevent from being wetted by rainwater via sliding the slide sleeve upward to gradually expand the umbrella cloth bottom-up. When not in use, the umbrella cloth can be collapsed via sliding the slide sleeve toward the handle. Further, the handle can collect rainwater.

In the splash-proof umbrella structure of the present invention, the handle further comprises a hollow cylinder and a turning knob installed below the cylinder. The cylinder and the turning knob respectively have a first through-hole and a second through-hole. When the two through-holes do not coincide, rainwater is stored in the cylinder to prevent from wetting the ground. When the turn knob is turned to make the two through-holes coincide, the stored rainwater is released via the through-holes.

DETAILED DESCRIPTION OF THE INVENTION

Figure 1:
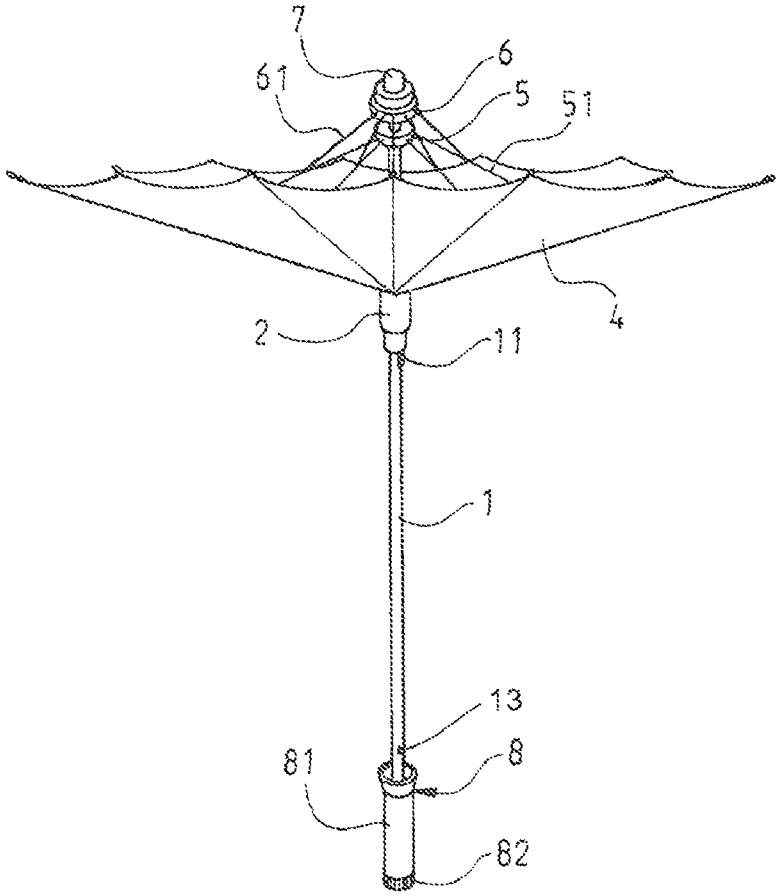
FIG. 1 is a perspective view schematically showing a splash-proof umbrella structure according to the present invention.
Figure 2:
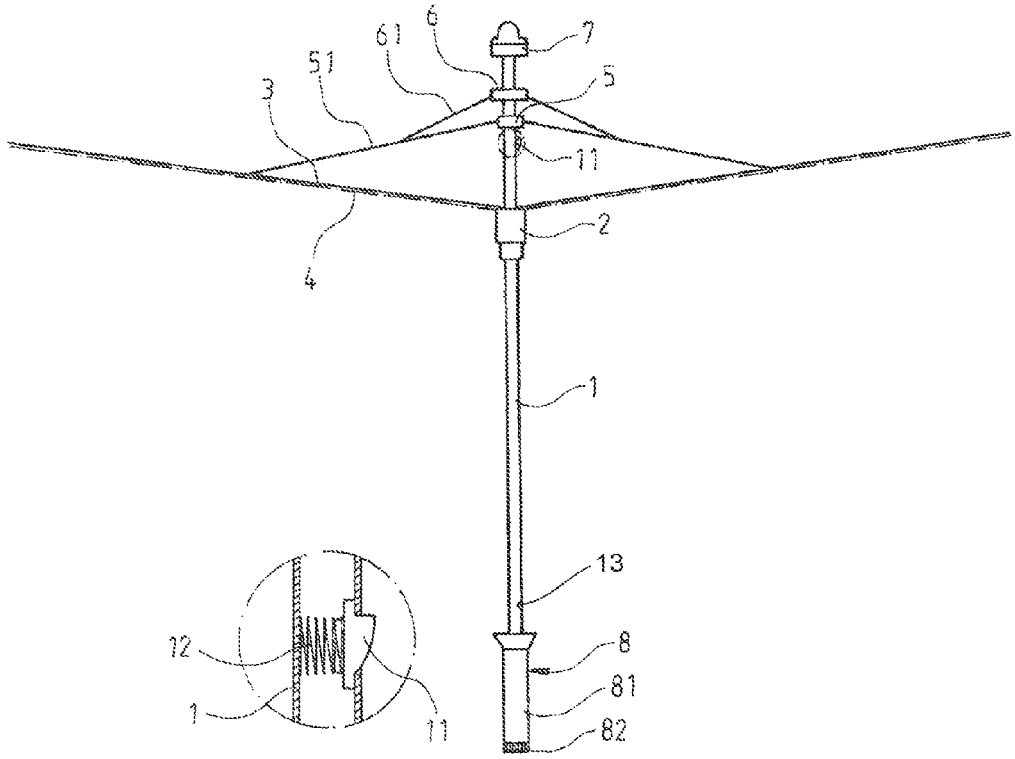
FIG. 2 is a structural diagram schematically showing a splash-proof umbrella structure according to the present invention.

Refer to FIG. 1 and FIG. 2 respectively a perspective view and a structural diagram schematically showing a splash-proof umbrella structure according to the present invention. The splash-proof umbrella structure of the present invention comprises a hollow rod 1. A press-fit element 11 is arranged on an appropriate position of the rod 1 and protrudes from the interior of the hollow rod 1. A spring 12 presses against the press-fit element 11. A via-hole 13 is formed on the lower side of the rod 1. A slide sleeve 2 is inserted through by the rod 1 and able to slide along the rod 1 up and down. A plurality of support sticks 3 is coupled to the slide sleeve 2. A piece of umbrella cloth 4 is arranged on the support sticks 3. The upper side of the rod 1 has a first rod sleeve 5 and a second rod sleeve 6. A fixing element 7 is arranged on the top of the rod 1.

The first rod sleeve 5 has a plurality of first link rods 51 coupled to the support sticks 3. The second rod sleeve 6 is arranged above the first rod sleeve 5 and has a plurality of second link rod 61 coupled to the first link rods 51. A water collecting handle 8 is arranged on the bottom of the rod 1. Thus is formed the splash-proof umbrella structure of the present invention. When a user gets off a vehicle in rain, he slides the slide sleeve 2 upward to gradually stretch out the support sticks 3 and the umbrella cloth 4 bottom-up and from inside to outside. Thus, the user can open the umbrella in a confined space to prevent from being wetted by rainwater although the vehicle door is only slightly opened. When the umbrella is not in use, the slide sleeve 2 is slid down toward the handle 8 to collapse the umbrella cloth 4. Further, rainwater flows through the via-hole 13 to the handle 8 and is collected in the handle 8 to prevent from wetting the ground.

Figure 3:
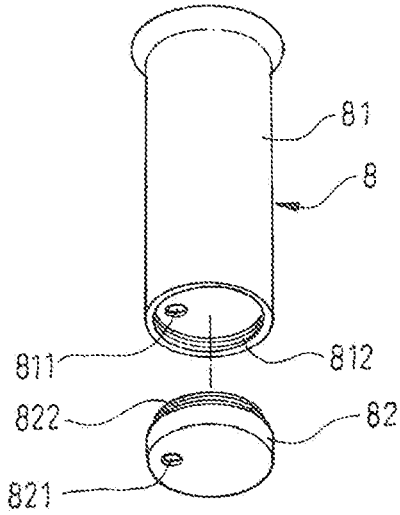
FIG. 3 is a perspective exploded view schematically showing a handle according to the present invention.
Figure 4:
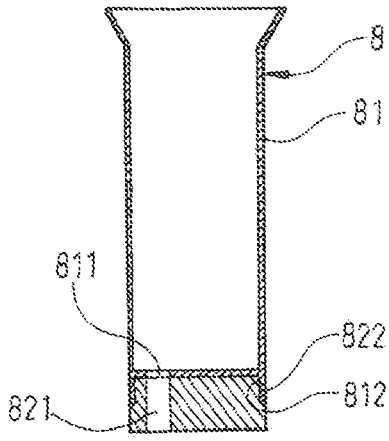
FIG. 4 is a sectional view schematically showing a handle according to the present invention.

Refer to FIG. 3 and FIG. 4 a perspective exploded view and a sectional view schematically showing a handle according to the present invention. The handle 8 is arranged on the bottom of the rod 1 and further comprises a hollow cylinder 81 and a turning knob 82 arranged on the bottom of the cylinder 81. The bottom of the cylinder 81 has a first through-hole 811 and a female thread 812 extending downward. The turning knob 82 has a second through-hole 821 and a male thread 822. The male thread 822 of the turning knob 82 can be screwed into the female thread 812 of the cylinder 81, whereby the turning knob 82 is rotatably coupled to the cylinder 81. When the first through-hole 811 does not coincide with the second through-hole 821, rainwater is stored in the cylinder 81 to prevent from wetting the ground. When the turning knob 82 is turned to make the second through-hole 821 coincide with the first through-hole 811, the stored rainwater is released via the first and second through-holes 811 and 821.

Figure 5:
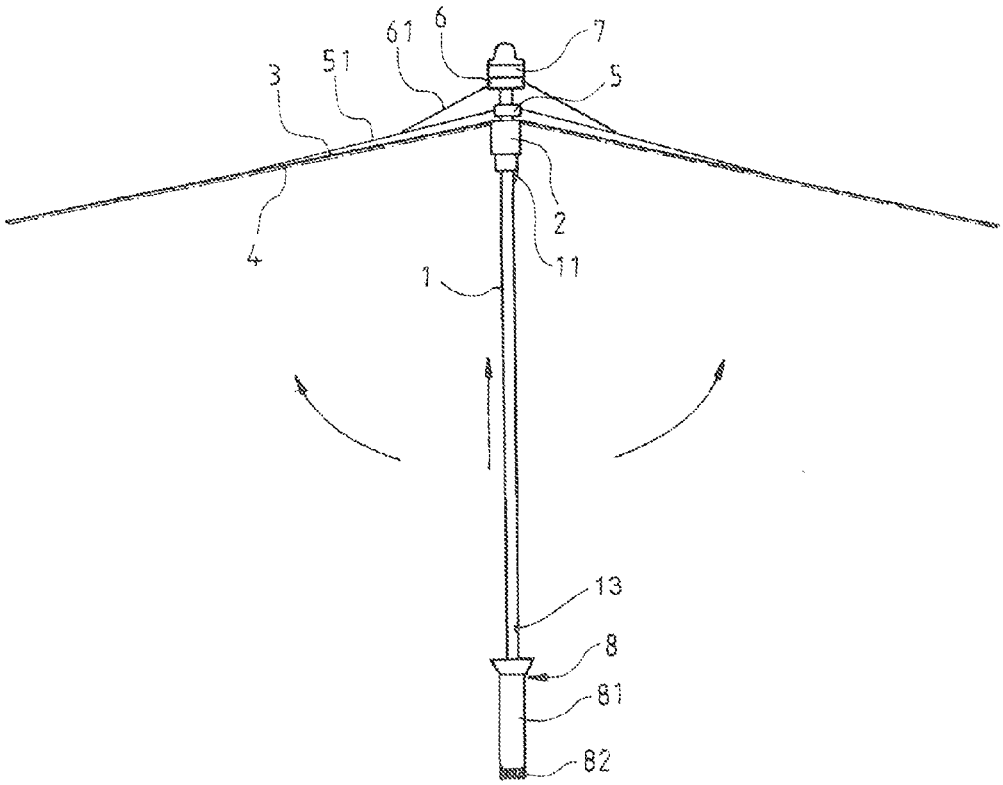
FIG. 5 is a diagram schematically showing the operation of a splash-proof umbrella structure according to the present invention.

Refer to FIG. 5 a diagram schematically showing the operation of a splash-proof umbrella structure according to the present invention. When a user intends to get off a vehicle in rain, he holds the handle 8 and slides the slide sleeve 2 upward to gradually stretch out the support sticks 3 and the umbrella cloth 4 bottom-up and from inside to outside. After the umbrella cloth 4 has been expanded, the pulling force of the first and second link rods 51 and 61 makes the lower rim of the slide sleeve 2 press-fit to the press-fit element 11, whereby the slide sleeve 2 is positioned well. Via the present invention, the user can open an umbrella in a confined space without opening the vehicle door too widely. Therefore, the present invention can prevent rainwater from wetting the user and the equipment inside the vehicle when the user is opening the umbrella.

Figure 6:
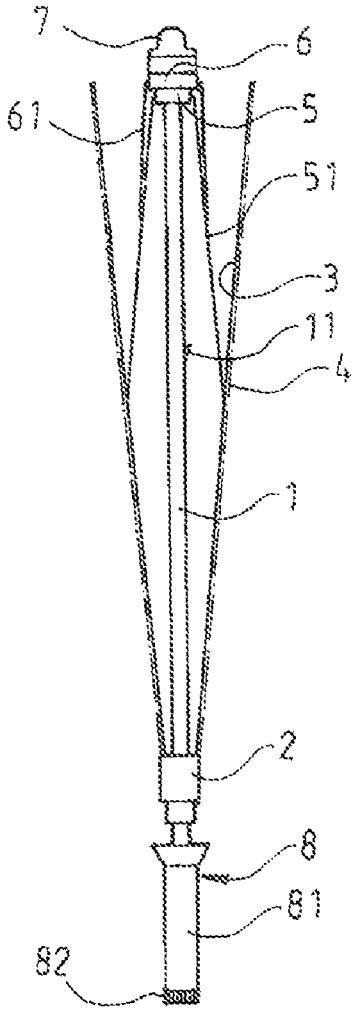
FIG. 6 is a diagram schematically showing that a splash-proof umbrella structure is collapsed according to the present invention.

Refer to FIG. 6 a diagram schematically showing that a splash-proof umbrella structure is collapsed according to the present invention. When the splash-proof umbrella structure of the present invention is not in use, the user presses down the press-fit element 11 and slides the slide sleeve 2 downward to gradually collapse the support sticks 3 and the umbrella cloth 4 top-down and from outside to inside. The rainwater on the collapsed umbrella cloth 4 flows through the slide sleeve 2 and the via-hole 13 of the rod 1 into the handle 8 to prevent from wetting the ground. The user can turn the turning knob 82 to release the rainwater stored in the handle 8.

In summary, the present invention uses a slidable slide sleeve, rod sleeves having a positioning function, and pivotally coupled support sticks and link rods to form a splash-proof umbrella structure, which can open in a confined space, and which can prevent a user and vehicle equipment from being wetted by rainwater when the user gets off a vehicle and opens an umbrella in rain.

The embodiments are only to exemplify the present invention but not to limit the scope of the present invention. Any equivalent modification or variation is regarded as not departing from the spirit of the present invention and is to be also included within the scope of the present invention.

What is claimed is:

1. A splash-proof umbrella structure comprising a rod passing through a slide sleeve, wherein said slide sleeve is able to slide up and down along said rod and coupled to a plurality of support sticks, and wherein a piece of umbrella cloth is arranged on said support sticks, and wherein a fixing element is arranged on a top of said rod;

a first rod sleeve arranged on an upper side of said rod and coupled to first link rods linking to said support sticks;

a second rod sleeve arranged on an upper side of said rod and coupled to second link rods linking to said first link rods; and a handle arranged on a bottom of said rod and being in the form of a hollow cylinder able to collect water, wherein said handle further includes said hollow cylinder and a turning knob arranged on a bottom of said hollow cylinder, and wherein said hollow cylinder further includes a first through-hole on a bottom thereof and a first thread extending downward, and wherein said turning knob further includes a second through-hole and a second thread, and wherein said second thread is rotatably engaged with said first thread, and wherein when said first through-hole does not coincide with said second through-hole, rainwater is stored inside said hollow cylinder to prevent from wetting the ground, and wherein when said turning knob is turned to make said second through-hole coincide with said first through-hole, rainwater is released via said first through-hole and said second through-hole;

wherein said splash-proof umbrella structure is opened in a confined space with a vehicle door only slightly opened by moving said slide sleeve upward to gradually stretch out said support sticks and said umbrella cloth bottom-up and from inside to outside so as to prevent rainwater from wetting said user or equipment of said vehicle, and wherein said umbrella cloth is collapsed by moving said slide sleeve downward to said handle, and wherein said handle collects rainwater to prevent from wetting the ground.

2. The splash-proof umbrella structure according to claim 1, wherein a press-fit element is arranged on an appropriate position of an upper side of said rod and protruding from said rod, and wherein a spring presses against said press-fit element, and wherein when said umbrella cloth has been stretched out, said press-fit element press-fits to a lower rim of said slide sleeve and fixes said slide sleeve.

* * * * *